US012723791B2

(12) United States Patent
Ikawa et al.

(10) Patent No.: US 12,723,791 B2
(45) Date of Patent: Sep. 1, 2026

(54) HEAT SOURCE UNIT AND REFRIGERANT HANDLING METHOD

(71) Applicant: DAIKIN INDUSTRIES, LTD., Osaka (JP)

(72) Inventors: Shinsuke Ikawa, Osaka (JP); Katsunori Murata, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 146 days.

(21) Appl. No.: 18/595,867

(22) Filed: Mar. 5, 2024

(65) Prior Publication Data

US 2024/0200840 A1 Jun. 20, 2024

Related U.S. Application Data

(63) Continuation of application No. PCT/JP2022/022058, filed on May 31, 2022.

(30) Foreign Application Priority Data

Sep. 30, 2021 (JP) ..... 2021-160314

(51) Int. Cl.
*F25B 45/00* (2006.01)
*F25B 41/24* (2021.01)

(52) U.S. Cl.
CPC ..... *F25B 45/00* (2013.01); *F25B 41/24* (2021.01); *F25B 2345/002* (2013.01); *F25B 2345/003* (2013.01); *F25B 2345/006* (2013.01)

(58) Field of Classification Search
CPC ..... F25B 49/02; F25B 49/005; F25B 13/00; F25B 2600/2519; F25B 41/20
See application file for complete search history.

(56) References Cited

U.S. PATENT DOCUMENTS

| | | | |
|---|---|---|---|
| 6,158,229 | A | 12/2000 | Aizawa |
| 2009/0272135 | A1 | 11/2009 | Nishimura et al. |
| 2021/0325068 | A1 | 10/2021 | Wakisaka |
| 2022/0170677 | A1 | 6/2022 | Forshaw |
| 2022/0260259 | A1 | 8/2022 | Minami |
| 2022/0260293 | A1 | 8/2022 | Minami |

(Continued)

FOREIGN PATENT DOCUMENTS

| | | | |
|---|---|---|---|
| CN | 106032955 A | | 10/2016 |
| CN | 106032955 B | * | 6/2020 |
| EP | 1 992 893 A1 | | 11/2008 |

(Continued)

OTHER PUBLICATIONS

International Search Report for PCT/JP2022/022058 (PCT/ISA/210) mailed on Jul. 26, 2022.

(Continued)

*Primary Examiner* — Ana M Vazquez
(74) *Attorney, Agent, or Firm* — Birch, Stewart, Kolasch & Birch, LLP

(57) ABSTRACT

A first shut-off valve (46) and a second shut-off valve (47) are closed when power supply to a heat source unit (20) is stopped. At least one of the first shut-off valve (46) or the second shut-off valve (47) which corresponds to a stop valve (41, 42) having a first service port (44) is closer to a heat source heat exchanger (22) than the stop valve (41, 42) having the first service port (44) is.

19 Claims, 8 Drawing Sheets

(56) References Cited

U.S. PATENT DOCUMENTS

2023/0417463 A1 12/2023 Forshaw

FOREIGN PATENT DOCUMENTS

| | | | |
|---|---|---|---|
| EP | 3 869 122 | A1 | 8/2021 |
| JP | 60-243453 | A | 12/1985 |
| JP | 4-320773 | A | 11/1992 |
| JP | H10-47814 | A | 2/1998 |
| JP | H11-142004 | A | 5/1999 |
| JP | 2000-28210 | A | 1/2000 |
| JP | 2000-28238 | A | 1/2000 |
| JP | 2000-59933 | A | 2/2000 |
| JP | 2000-180000 | A | 6/2000 |
| JP | 2002-130875 | A | 5/2002 |
| JP | 2003-269825 | A | 9/2003 |
| JP | 2005-282967 | A | 10/2005 |
| JP | 3956997 | B1 | 5/2007 |
| JP | 2008-89292 | A | 4/2008 |
| JP | 2013-178039 | A | 9/2013 |
| JP | 2015-206517 | A | 11/2015 |
| JP | 2016-1097 | A | 1/2016 |
| JP | 3223773 | U | 10/2019 |
| JP | 2020-109343 | A | 7/2020 |
| JP | 2021-076264 | A | 5/2021 |
| JP | 2021-85642 | A | 6/2021 |
| JP | 2021-85643 | A | 6/2021 |
| JP | 2021-131200 | A | 9/2021 |
| WO | WO 2020/240159 | A1 | 12/2020 |

OTHER PUBLICATIONS

International Preliminary Report on Patentability and English translation of the Written Opinion of the International Searching Authority for International Application No. PCT/JP2022/022058, dated Apr. 11, 2024.

Extended European Search Report for European Application No. 22875452.9, dated Nov. 5, 2024.

* cited by examiner

HEAT SOURCE UNIT AND REFRIGERANT HANDLING METHOD

CROSS REFERENCE TO RELATED APPLICATIONS

This application is a Continuation of PCT International Application No. PCT/JP2022/022058, filed on May 31, 2022, which claims priority under 35 U.S.C. 119(a) to Patent Application No. 2021-160314, filed in Japan on Sep. 30, 2021, all of which are hereby expressly incorporated by reference into the present application.

TECHNICAL FIELD

The present disclosure relates to a heat source unit and a refrigerant handling method.

BACKGROUND ART

Refrigeration apparatuses including a refrigeration cycle in which a refrigerant circulates have been known. The refrigeration cycle of Patent Document 1 has a refrigerant recovery mode. In this refrigerant recovery mode, bringing all of the valves provided at an intermediate portion of each of pipes in the refrigeration cycle into an open state enables recovery of the whole amount of the refrigerant in the refrigeration cycle.

CITATION LIST

Patent Document

Patent Document 1: Japanese Unexamined Patent Publication No. H04-320773

SUMMARY

A first aspect is directed to a heat source unit (20) connected to a utilization unit (30) including a utilization heat exchanger (31), the heat source unit (20) performing a refrigeration cycle using a refrigerant that circulates. The heat source unit (20) includes: a compressor (21); a heat source heat exchanger (22); a gas line (26) having one end joined to a gas end of the heat source heat exchanger (22); a liquid line (27) having one end joined to a liquid end of the heat source heat exchanger (22); a first stop valve (41) and a first shut-off valve (46) which are connected to a portion of the gas line (26) near another end of the gas line (26); and a second stop valve (42) and a second shut-off valve (47) which are connected to a portion of the liquid line (27) near another end of the liquid line (27), wherein the first shut-off valve (46) and the second shut-off valve (47) are closed when power supply to the heat source unit (20) is stopped, at least one of the first stop valve (41) or the second stop valve (42) has a first service port (44), and at least one of the first shut-off valve (46) or the second shut-off valve (47) which corresponds to the at least one of the stop valves (41, 42) having the first service port (44) is closer to the heat source heat exchanger (22) than the at least one of the stop valves (41, 42) having the first service port (44) is.

DESCRIPTION OF EMBODIMENTS

Figure 1:
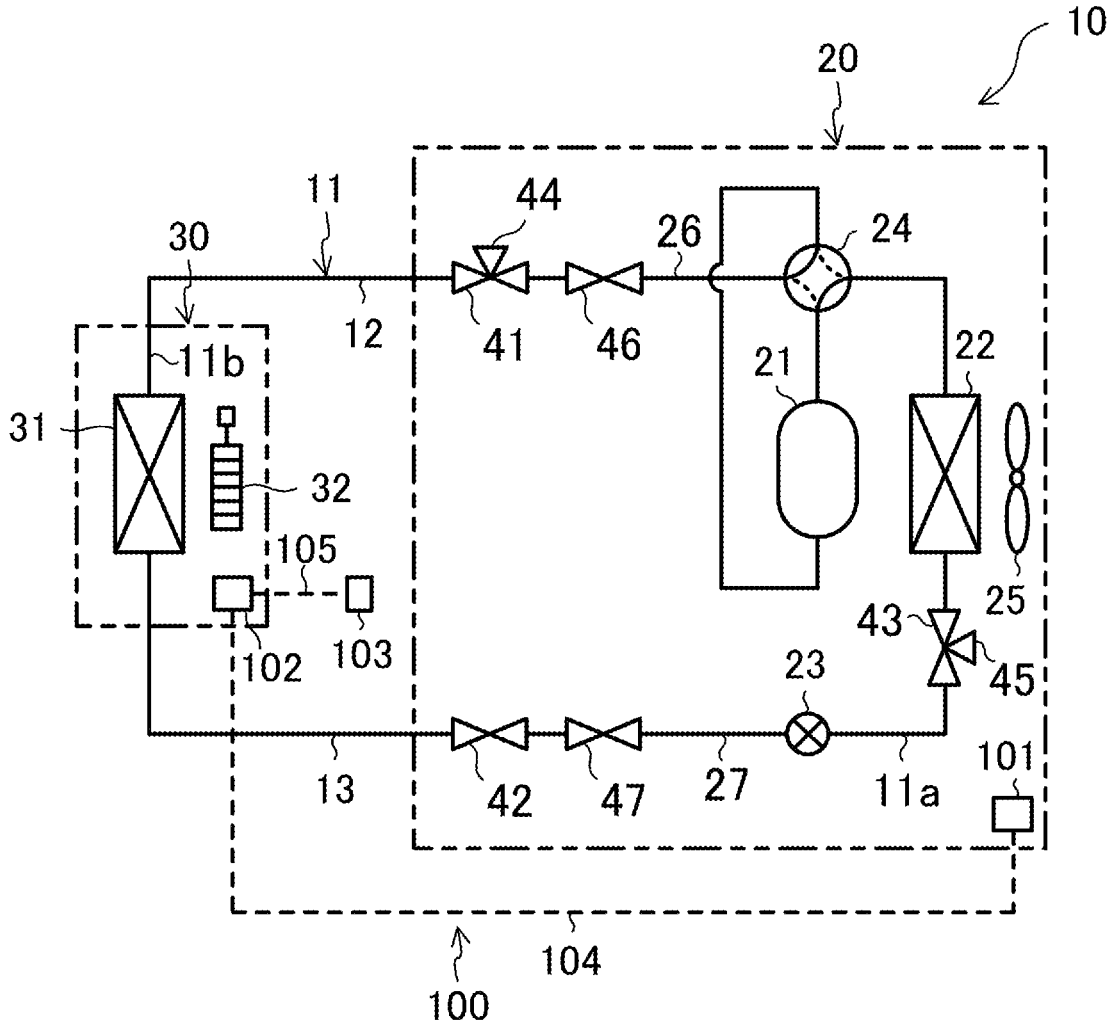
FIG. 1 is a schematic piping system diagram of an air conditioner including an outdoor unit according to an embodiment.

Embodiments of the present disclosure will be described in detail below with reference to the drawings. The present disclosure is not limited to the embodiments shown below, and various changes can be made within the scope without departing from the technical concept of the present disclosure. Since each of the drawings is intended to illustrate the present disclosure conceptually, dimensions, ratios, or numbers may be exaggerated or simplified as necessary for the sake of ease of understanding.

(1) Configuration of Air Conditioner

A refrigeration apparatus (10) including a heat source unit (20) of the present disclosure will be described with reference to FIGS. 1 and 2. The refrigeration apparatus (10) according to this embodiment is an air conditioner that adjusts the air temperature in an indoor space.

The air conditioner (10) performs a cooling operation and a heating operation. In the cooling operation, the air conditioner (10) cools the air in the indoor space. In the heating operation, the air conditioner (10) heats the air in the indoor space.

The air conditioner (10) includes a refrigerant circuit (11). The refrigerant circuit (11) is filled with a flammable refrigerant. The refrigerant circuit (11) circulates the refrigerant therethrough to perform a refrigeration cycle.

The air conditioner (10) includes an outdoor unit (20) as a heat source unit, an indoor unit (30) as a utilization unit, a first connection pipe (12), and a second connection pipe (13). The air conditioner (10) is of a pair type that includes one outdoor unit (20) and one indoor unit (30). The refrigerant circuit (11) includes an outdoor circuit (11*a*) corresponding to the outdoor unit (20) and an indoor circuit (11*b*) corresponding to the indoor unit (30).

Power is supplied from a commercial power source (E) to the air conditioner (10). Specifically, the commercial power source (E) is connected to a power supply circuit of the indoor unit (30). Thus, power is supplied to the indoor unit (30) to cause the indoor unit (30) to operate. Further, the commercial power source (E) is connected to a power supply circuit of the outdoor unit (20) via the indoor unit (30). Thus, power is supplied to the outdoor unit (20) as well to cause the outdoor unit (20) to operate.

(1-1) Outdoor Unit

The outdoor unit (20) is installed in an outdoor space. As illustrated in FIG. 1, the outdoor unit (20) includes a compressor (21), an outdoor heat exchanger (22), an expansion valve (23), a four-way switching valve (24), and an outdoor fan (25). The compressor (21), the outdoor heat exchanger (22), the expansion valve (23), and the four-way switching valve (24) are connected to the outdoor circuit (11*a*) of the outdoor unit (20). The outdoor heat exchanger (22) corresponds to a heat source heat exchanger of the present disclosure.

The compressor (21) compresses the refrigerant. The compressor (21) is a rotary compressor. The outdoor heat exchanger (22) exchanges heat between the refrigerant and outdoor air. The outdoor heat exchanger (22) is a fin-and-tube heat exchanger. The outdoor fan (25) transfers outdoor air. The air transferred by the outdoor fan (25) passes through the outdoor heat exchanger (22). The outdoor fan (25) is a propeller fan. The expansion valve (23) decompresses the refrigerant. The expansion valve (23) is an electronic or temperature-sensitive expansion valve.

The four-way switching valve (24) reverses the flow of the refrigerant in the refrigerant circuit (11). The four-way switching valve (24) switches between a first state indicated by solid lines in FIG. 1 and a second state indicated by broken lines in FIG. 1. The four-way switching valve (24) in the first state makes a discharge side of the compressor (21) and a gas side of the outdoor heat exchanger (22) communicate with each other, and simultaneously makes a suction side of the compressor (21) and a gas side of an indoor heat exchanger (31) communicate with each other. The four-way switching valve (24) in the second state makes the discharge side of the compressor (21) and the gas side of the indoor heat exchanger (31) communicate with each other, and simultaneously makes the suction side of the compressor (21) and the gas side of the outdoor heat exchanger (22) communicate with each other.

(1-2) Indoor Unit

The indoor unit (30) is installed in an indoor space. As illustrated in FIG. 1, the indoor unit (30) includes the indoor heat exchanger (31) and an indoor fan (32). The indoor heat exchanger (31) is connected to the indoor circuit (11*b*) of the indoor unit (30). The indoor heat exchanger (31) corresponds to a utilization heat exchanger of the present disclosure.

The indoor heat exchanger (31) exchanges heat between the refrigerant and indoor air. The indoor heat exchanger (31) is a fin-and-tube heat exchanger. The indoor fan (32) is a cross-flow fan configured to transfer indoor air. The air transferred by the indoor fan (32) passes through the indoor heat exchanger (31).

(1-3) First and Second Connection Pipes

The first and second connection pipes (12) and (13) connect the indoor unit (30) and the outdoor unit (20) together. The first connection pipe (12) is a gas pipe, and the second connection pipe (13) is a liquid pipe. The first connection pipe (12) has one end connected to a gas end of the indoor circuit (11*b*), and the other end connected to a gas end of the outdoor circuit (11*a*). The second connection pipe (13) has one end connected to a liquid end of the indoor circuit (11*b*), and the other end connected to a liquid end of the outdoor circuit (11*a*).

(1-4) Refrigerant

The refrigerant circuit (11) is filled with a flammable natural refrigerant. The refrigerant in this example is propane (R290), which is a highly flammable natural refrigerant. The natural refrigerant has zero ozone depletion potential and low global warming potential, and exerts less load on the environment.

The flammable refrigerant with which the refrigerant circuit (11) is filled may be other than propane. The flammable refrigerant with which the refrigerant circuit (11) is filled may be, for example, ammonia (R717), which is a natural refrigerant. Alternatively, the flammable refrigerant with which the refrigerant circuit (11) is filled may be methane (R50), ethane (R170), butane (R600), or isobutane (R600*a*), which is a highly flammable natural refrigerant.

(2) Details of Outdoor Unit

The outdoor unit (20) further includes a gas line (26), a liquid line (27), a first stop valve (41), a second stop valve (42), a third stop valve (43), a first shut-off valve (46), and a second shut-off valve (47). The first stop valve (41), the second stop valve (42), the third stop valve (43), the first shut-off valve (46), and the second shut-off valve (47) are connected to the outdoor circuit (11*a*) of the outdoor unit (20).

In the outdoor circuit (11*a*), one end of the gas line (26) is joined to a gas end of the outdoor heat exchanger (22). In the outdoor circuit (11*a*), one end of the liquid line (27) is joined to a liquid end of the outdoor heat exchanger (22). The gas line (26) is configured as a gas pipe through which the gas refrigerant before condensation or heat dissipation in the outdoor heat exchanger (22) flows. The four-way switching valve (24) and the compressor (21) are connected to the gas line (26). The liquid line (27) is configured as a liquid pipe through which the liquid refrigerant after condensation or heat dissipation in the outdoor heat exchanger (22) flows. The expansion valve (23) is connected to the liquid line (27).

The first stop valve (41) and the first shut-off valve (46) are connected to the gas line (26) near the other end. Specifically, the first stop valve (41) is connected to the other end of the gas line (26) of this embodiment. The first shut-off valve (46) is located at a portion of the gas line (26) so as to be closer to the outdoor heat exchanger (22) than the first stop valve (41) is. The first shut-off valve (46) is closer to the first stop valve (41) than the four-way switching valve (24) and the compressor (21) are.

The second stop valve (42) and the second shut-off valve (47) are connected to the liquid line (27) near the other end. Specifically, the second stop valve (42) is connected to the other end of the liquid line (27) of this embodiment. The second shut-off valve (47) is located at a portion of the liquid line (27) so as to be closer to the outdoor heat exchanger (22) than the second stop valve (42) is. The second shut-off valve (47) is located between the second stop valve (42) and the expansion valve (23) in the liquid line (27).

The third stop valve (43) is closer to the outdoor heat exchanger (22) than the first shut-off valve (46) of the gas line (26) and the second shut-off valve (47) of the liquid line (27). In this embodiment, the third stop valve (43) is connected to the liquid line (27). Specifically, the third stop valve (43) is located between the outdoor heat exchanger (22) and the expansion valve (23) in the liquid line (27). The third stop valve (43) may be located between the expansion valve (23) and the second shut-off valve (47) as long as the third stop valve (43) is connected to the liquid line (27).

The first stop valve (41), the second stop valve (42), and the third stop valve (43) are configured to open and close the corresponding line (26, 27). At least one of the first stop valve (41) or the second stop valve (42) has a first service port (44). In this embodiment, the first stop valve (41) has the first service port (44). The third stop valve (43) has a second service port (45). The opening area of the second service port (45) is greater than the opening area of the first service port (44).

The service ports are openings for filling the outdoor unit (20) with the refrigerant, recovering the refrigerant from the outdoor unit (20), and measuring the pressure of the refrigerant, for example. During a normal operation of the air conditioner (10), the first and second service ports (44) and (45) are maintained in a closed state.

The first and second shut-off valves (46) and (47) are closed when power supply to the outdoor unit (20) is stopped. The first and second shut-off valves (46) and (47) of this embodiment are configured as electromagnetic valves.

(3) Remote Controller and Control Unit

Figure 2:
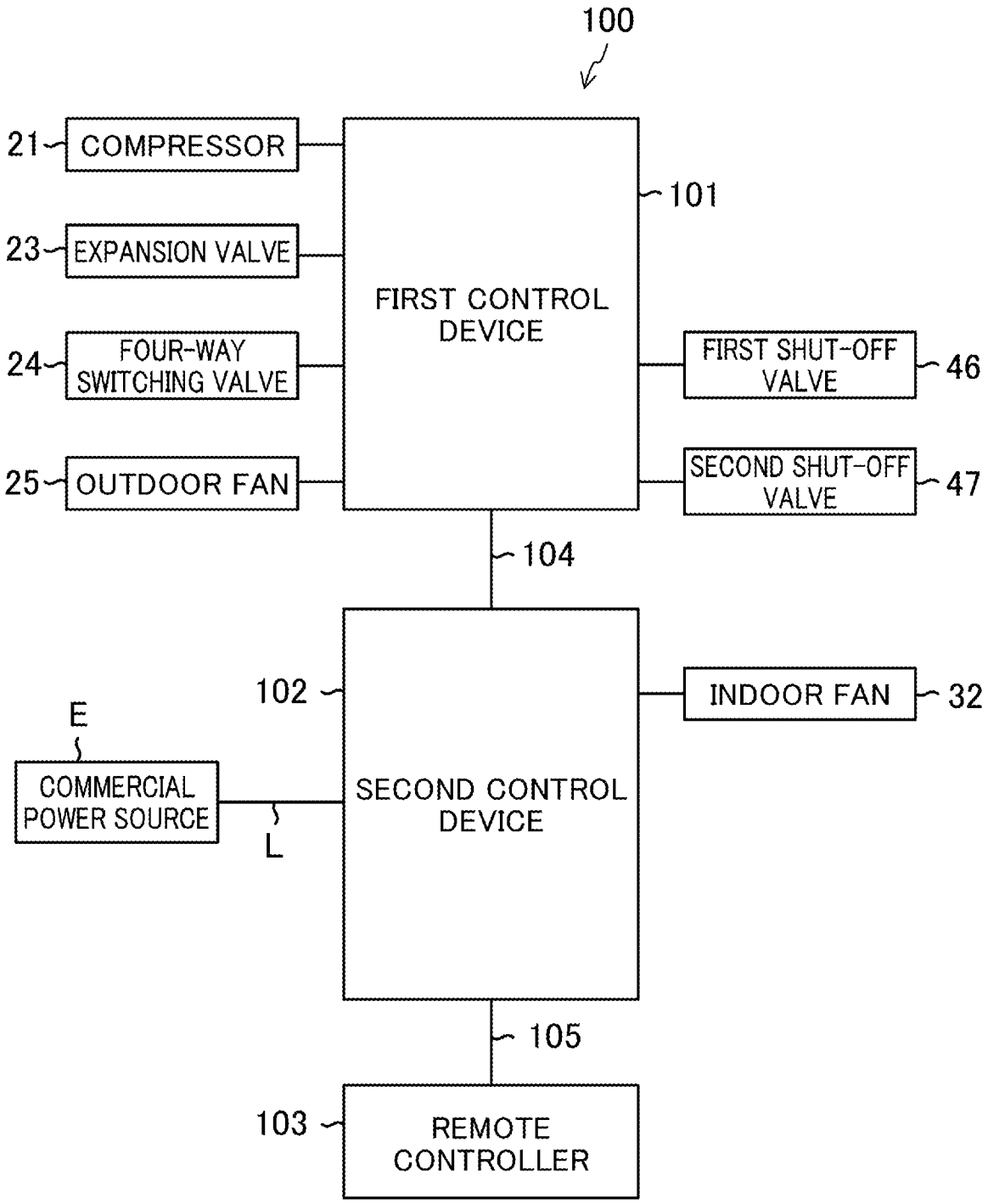
FIG. 2 is a block diagram of the air conditioner.

As illustrated in FIGS. 1 and 2, the air conditioner (10) has a remote controller (103). The remote controller (103) is used by a person in inputting various instructions to the air conditioner (10). The remote controller (103) includes a switch, a button, or a touch panel. The operation of the air conditioner (10) is selected by the person operating the remote controller (103). The operation of the air conditioner (10) includes a cooling operation and a heating operation.

The air conditioner (10) has a control unit (100). The control unit (100) controls operation of the air conditioner (10). The control unit (100) controls operations of the shut-off valves (46, 47). The control unit (100) includes a first control device (101), a second control device (102), the remote controller (103), a first communication line (104), and a second communication line (105).

The control unit (100) includes a micro controller unit (MCU), an electric circuit, and an electronic circuit. The MCU includes a central processing unit (CPU), a memory, and a communication interface. The memory stores various programs to be executed by the CPU.

The first control device (101) is provided in the outdoor unit (20). The second control device (102) is provided in the indoor unit (30). The first and second control devices (101) and (102) are connected to each other via the first communication line (104). The second control device (102) and the remote controller (103) are connected to each other via the second communication line (105). The first and second communication lines (104) and (105) are wired or wireless. The second control device (102) is connected to the commercial power source (E) through a power distribution line (L) via a power terminal (not shown).

The first control device (101) controls the compressor (21), the expansion valve (23), the four-way switching valve (24), and the outdoor fan (25) in response to a received command. The second control device (102) controls the indoor fan (32) in response to a received command. The first control device (101) controls the first and second shut-off valves (46) and (47) in accordance with whether or not power is supplied from the commercial power source (E).

The control unit (100) switches between the cooling operation and the heating operation in response to a received command. The control unit (100) opens the first shut-off valve (46) and the second shut-off valve (47) when the power supply from the commercial power source (E) starts. The control unit (100) closes the first shut-off valve (46) and the second shut-off valve (47) when the power supply from the commercial power source (E) is stopped.

(4) Operation of Air Conditioner

Next, operation of the air conditioner (10) will be described. The air conditioner (10) switchably performs the cooling operation and the heating operation.

(4-1) Cooling Operation

In the cooling operation, the control unit (100) sets the four-way switching valve (24) in the first state. In the cooling operation, the control unit (100) operates the compressor (21), the outdoor fan (25), and the indoor fan (32), and adjusts the opening degree of the expansion valve (23).

The refrigerant circuit (11) during the cooling operation performs a refrigeration cycle (cooling cycle) in which the outdoor heat exchanger (22) functions as a radiator and the indoor heat exchanger (31) functions as an evaporator.

(4-2) Heating Operation

In the heating operation, the control unit (100) sets the four-way switching valve (24) in the second state. In the heating operation, the control unit (100) operates the compressor (21), the outdoor fan (25), and the indoor fan (32), and adjusts the opening degree of the expansion valve (23).

The refrigerant circuit (11) during the heating operation performs a refrigeration cycle (heating cycle) in which the indoor heat exchanger (31) functions as a radiator and the outdoor heat exchanger (22) functions as an evaporator.

(5) Refrigerant Handling Method

Figure 3:
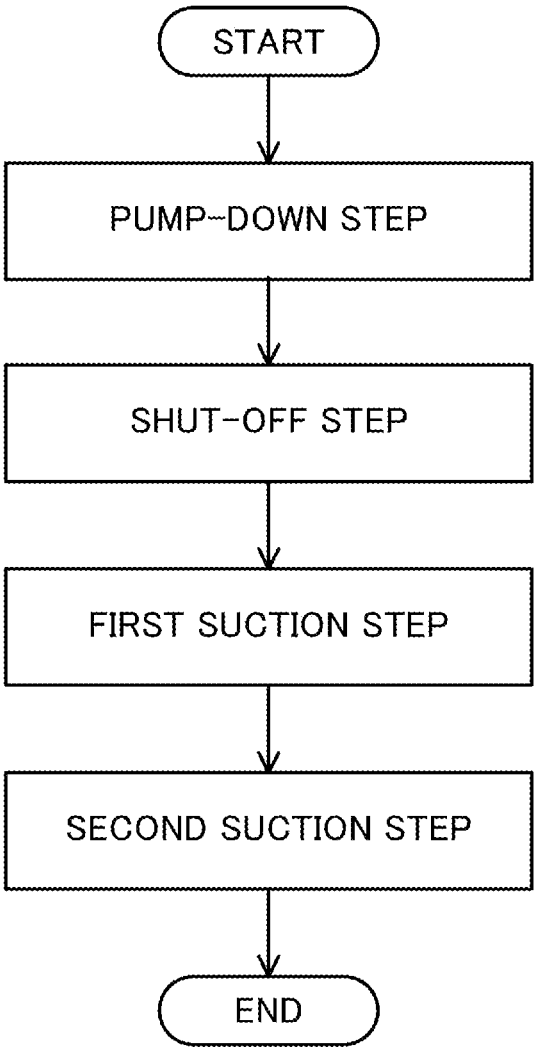
FIG. 3 is a flowchart for explaining a refrigerant handling method according to an embodiment.

Next, a refrigerant handling method for handling the refrigerant with which the refrigerant circuit (11) is filled will be described. As illustrated in FIG. 3, in the refrigerant handling method, a pump-down step, a shut-off step, a first suction step, and a second suction step are performed sequentially.

(5-1) Pump-Down Step

The pump-down step corresponds to a fourth step of the present disclosure. In the pump-down step, the air conditioner (10) performs a pump-down operation of moving the refrigerant on the indoor unit (30) side (the indoor unit (30), the first connection pipe (12), and the second connection pipe (13)) to the outdoor unit (20).

Specifically, in the pump-down step, an operator closes only the second stop valve (42) from the state where the first and second stop valves (41) and (42) of the outdoor unit (20) are open. Then, the operator operates the remote controller (103) so that the cooling operation is performed. Thus, the refrigerant on the indoor unit (30) side is sucked by the compressor (21) and moves to the outdoor unit (20). The operator then closes the first stop valve (41). Thus, the refrigerant in the refrigerant circuit (11) is accumulated in the outdoor unit (20).

The pump-down step makes less refrigerant left on the indoor unit (30) side. Thus, even when the indoor unit (30) and the outdoor unit (20) are disconnected from each other for maintenance or relocation of the air conditioner (10), it is possible to keep the flammable refrigerant from leaking from the indoor unit (30) side and being released into the atmosphere.

(5-2) Shut-Off Step

The shut-off step corresponds to a first step of the present disclosure. In the shut-off step, the refrigerant circuit (11) is shut off between the indoor unit (30) and the outdoor unit (20). Specifically, the shut-off step includes a first shut-off step and a second shut-off step. The first shut-off step corresponds to a fifth step of the present disclosure. The second shut-off step corresponds to a sixth step of the present disclosure. In the first shut-off step, the first shut-off valve (46) and the second shut-off valve (47) are closed. In the second shut-off step, the first stop valve (41) and the second stop valve (42) are closed.

Specifically, in this embodiment, first, in the first shut-off step, the operator turns off the power source of the air conditioner (10). Power supply to the indoor unit (30) and the outdoor unit (20) is stopped when the power source of the air conditioner (10) is turned off.

Figure 4:
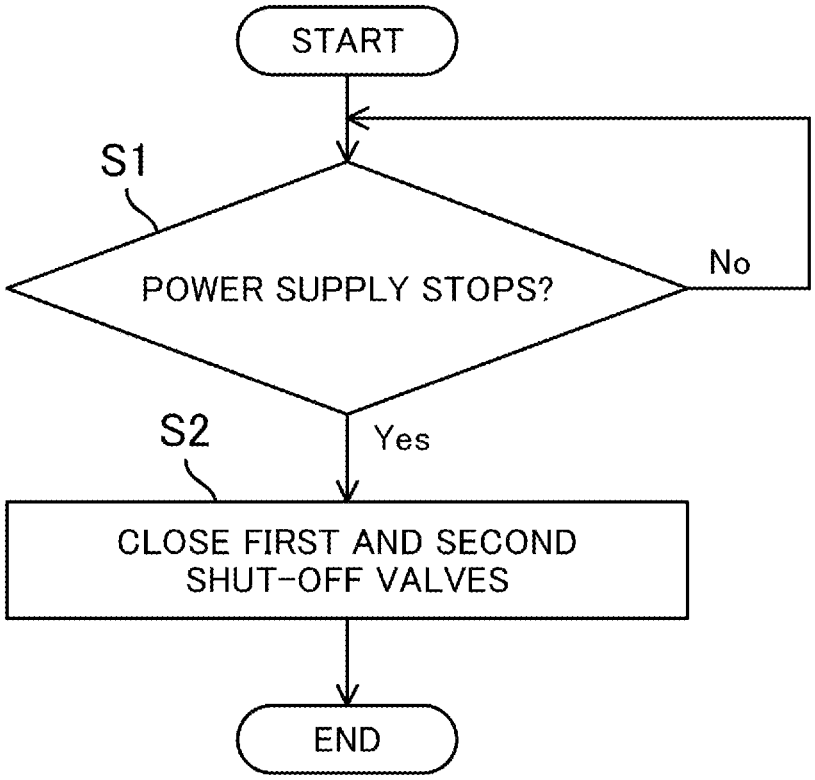
FIG. 4 is a flowchart showing an operation of a control unit (100) in a first shut-off step.

At this timing, as illustrated in FIG. 4, the control unit (100) determines in step S1 whether the power supply to the outdoor unit (20) has been stopped. If the control unit (100) determines that the power supply to the outdoor unit (20) has been stopped ("YES" in step S1), the control unit (100) performs step S2.

In step S2, the control unit (100) transmits a signal for closing a valve to each of the first and second shut-off valves

(46) and (47) of the outdoor unit (20), thereby closing the first and second shut-off valves (46) and (47).

Next, in the second shut-off step, the operator checks whether the first stop valve (41) and the second stop valve (42) are completely closed. If the first stop valve (41) and the second stop valve (42) have not been closed completely in the pump-down step, the operator completely closes the first stop valve (41) and the second stop valve (42) in the second shut-off step. The first shut-off step may be performed first, or the second shut-off step may be performed first.

As described above, in the refrigerant circuit (11), the indoor unit (30) side and the outdoor unit (20) are shut off from each other in two stages by the first shut-off step and the second shut-off step. This reduces the leakage of the flammable refrigerant from the outdoor unit (20).

(5-3) First Suction Step

The first suction step corresponds to a second step of the present disclosure. In the first suction step, the refrigerant on the indoor unit (30) side is sucked on the site where the air conditioner (10) is installed.

Specifically, in the first suction step, the operator connects a refrigerant recovery device to the first service port (44) for the first stop valve (41) on the site where the air conditioner (10) is installed. The refrigerant recovery device connected to the refrigerant circuit (11) sucks therein the refrigerant on the indoor unit (30) side.

Since the first suction step is performed after the shut-off step as described above, the refrigerant recovery device needs to recover only the refrigerant on the indoor unit (30) side on the site where the air conditioner (10) is installed. This can shorten the time required for the task of recovering the refrigerant.

The refrigerant recovery device may be a refrigerant handling device that burns and disposes the flammable refrigerant. In this case, the refrigerant recovered from the indoor unit (30) side can be disposed on the site where the air conditioner (10) is installed. This can lower the ignition risk caused by the refrigerant leakage from the indoor unit (30) side during the recovery of the refrigerant. In addition, although prior notification and permission are required to recover the flammable refrigerant, the use of the refrigerant handling device eliminates the need for such prior notification or the like. This can reduce the labor required to recover the refrigerant.

(5-4) Second Suction Step

The second suction step corresponds to a third step of the present disclosure. In the second suction step, the refrigerant in the outdoor unit (20) is sucked through a facility that recovers the refrigerant.

Specifically, in the second suction step, the operator initially transports the outdoor unit (20) from the site where the air conditioner (10) is installed to a factory equipped with the facility that recovers the refrigerant. Next, the operator connects the facility that recovers the refrigerant to the second service port (45) of the transported outdoor unit (20) that has been transported. The facility that recovers the refrigerant sucks and recovers the refrigerant in the outdoor unit (20) when the outdoor unit (20) is connected to the facility.

Since the refrigerant in the outdoor unit (20) is sucked and recovered in the second suction step on the site other than the site where the air conditioner (10) is installed, it is possible to shorten the work time on the site where the air conditioner (10) is installed than in a case of recovering the whole amount of the refrigerant filling the air conditioner (10) on the site where the air conditioner (10) is installed.

Here, the opening area of the second service port (45) is greater than the opening area of the first service port (44). Thus, the refrigerant is more easily discharged through the second service port (45) than through the first service port (44). This can shorten the refrigerant recovery time required for the facility that recovers the refrigerant.

Furthermore, the third stop valve (43) having the second service port (45) is located between the outdoor heat exchanger (22) and the expansion valve (23) in the liquid line (27). In other words, the second service port (45) is located in a portion of the liquid line (27) near the outdoor heat exchanger (22). In the outdoor unit (20), a large amount of the refrigerant is accumulated in the outdoor heat exchanger (22). Thus, the second service port (45) located near the outdoor heat exchanger (22) can reduce the refrigerant that remains in the outdoor unit (20) in recovering the refrigerant in the outdoor unit (20).

(6) Features (6-1)

The first and second shut-off valves (46) and (47) are closed when power supply to the outdoor unit (20) is stopped. At least one of the first stop valve (41) or the second stop valve (42) has a first service port (44). At least one (46, 47) of the first shut-off valve (46) or the second shut-off valve (47) that corresponds to the stop valve (41, 42) having the first service port (44) is closer to the outdoor heat exchanger (22) than the stop valve (41, 42) having the first service port (44) is.

The first shut-off valve (46) and the second shut-off valve (47) are closed when power supply to the outdoor unit (20) is stopped. When the first shut-off valve (46) and the second shut-off valve (47) are closed, the outdoor unit (20) and the indoor unit (30) are disconnected from each other, thereby trapping the refrigerant in the outdoor unit (20). The shut-off valve (46, 47) that corresponds to the stop valve (41, 42) having the first service port (44) is closer to the outdoor heat exchanger (22) than the stop valve (41, 42) having the first service port (44) is. It is therefore possible to recover the refrigerant on the indoor unit (30) side from the first service port (44), with the refrigerant on the outdoor unit (20) side trapped in the outdoor unit (20). As a result, the time required for the task of recovering the refrigerant can be shortened while the refrigerant leakage from the outdoor unit (20) is reduced.

(6-2)

The first stop valve (41) has the first service port (44). The first shut-off valve (46) is closer to the outdoor heat exchanger (22) than the first stop valve (41) is. By closing the first stop valve (41) in recovering the refrigerant, it is possible to further reduce the refrigerant leakage from the outdoor unit (20) and recover the refrigerant on the indoor unit (30) side from the first service port (44) of the first stop valve (41).

(6-3)

The second shut-off valve (47) is closer to the outdoor heat exchanger (22) than the second stop valve (42) is. By closing the second stop valve (42) in recovering the refrigerant, it is possible to further reduce the refrigerant leakage from the outdoor unit (20).

(6-4)

The outdoor unit (20) includes the third stop valve (43) having the second service port (45). The third stop valve (43) is closer to the outdoor heat exchanger (22) than the first shut-off valve (46) of the gas line (26) and the second shut-off valve (47) of the liquid line (27) are. Since the third stop valve (43) having the second service port (45) is closer to the outdoor heat exchanger (22) than the first shut-off valve (46) and the second shut-off valve (47) are, it is possible to discharge the refrigerant in the outdoor unit (20) to the outside and recover the refrigerant by opening the second service port (45) after closing the first shut-off valve (46) and the second shut-off valve (47).

(6-5)

The third stop valve (43) is connected to the liquid line (27). Since the third stop valve (43) is connected to the liquid line (27) where the refrigerant accumulates easily, the refrigerant in the outdoor unit (20) is discharged to the outside more easily.

(6-6)

The opening area of the second service port (45) is greater than the opening area of the first service port (44). Accordingly, the refrigerant is discharged through the second service port (45) more easily than through the first service port (44).

(6-7)

The refrigerant with which the refrigerant circuit (11) is filled is a flammable refrigerant. Since the flammable refrigerant circulates through the outdoor unit (20) and the indoor unit (30), the ignition risk caused by the leakage is high. This refrigerant with high ignition risk can be trapped in the outdoor unit (20), which makes it possible to reduce the ignition risk caused by the refrigerant leakage.

(6-8)

The refrigerant handling method of this embodiment includes the shut-off step of shutting off the refrigerant circuit (11) between the indoor unit (30) and the outdoor unit (20) on the site where the air conditioner (10) is installed, the first suction step of, after the end of the shut-off step, sucking the refrigerant on the indoor unit (30) side on the site where the air conditioner (10) is installed, and the second suction step of, after the end of the first suction step, sucking the refrigerant in the outdoor unit (20) through the facility that recovers the refrigerant.

In the shut-off step, the indoor unit (30) and the outdoor unit (20) are shut off from each other. Thus, the indoor unit (30) and the outdoor unit (20) are disconnected from each other, thereby trapping the refrigerant in the outdoor unit (20). After the shut-off step, the refrigerant on the indoor unit (30) side is sucked and recovered in the first suction step. As a result, the time required for the task of recovering the refrigerant can be shortened while the refrigerant leakage from the outdoor unit (20) is reduced, on the site where the air conditioner (10) is installed.

(6-9)

The method further includes the pump-down step of performing a pump-down operation of moving the refrigerant on the indoor unit (30) side to the outdoor unit (20). The shut-off step is performed after the end of the pump-down step. The pump-down operation performed in the pump-down step causes the refrigerant on the indoor unit (30) side to move to the outdoor unit (20). This reduces the risk of the refrigerant leakage from the indoor unit (30) side.

(6-10)

The shut-off step includes the first shut-off step of closing the first shut-off valve (46) and the second shut-off valve (47) and the second shut-off step of closing the first stop valve (41) and the second stop valve (42). In the refrigerant circuit (11), the indoor unit (30) and the outdoor unit (20) are shut off from each other in two stages by the first shut-off step and the second shut-off step. This further reduces the refrigerant leakage from the outdoor unit (20).

(7) Variations

The foregoing embodiment may be modified as the following variations. In the following description, differences from the embodiment will be described in principle.

(7-1) First Variation

Figure 5:
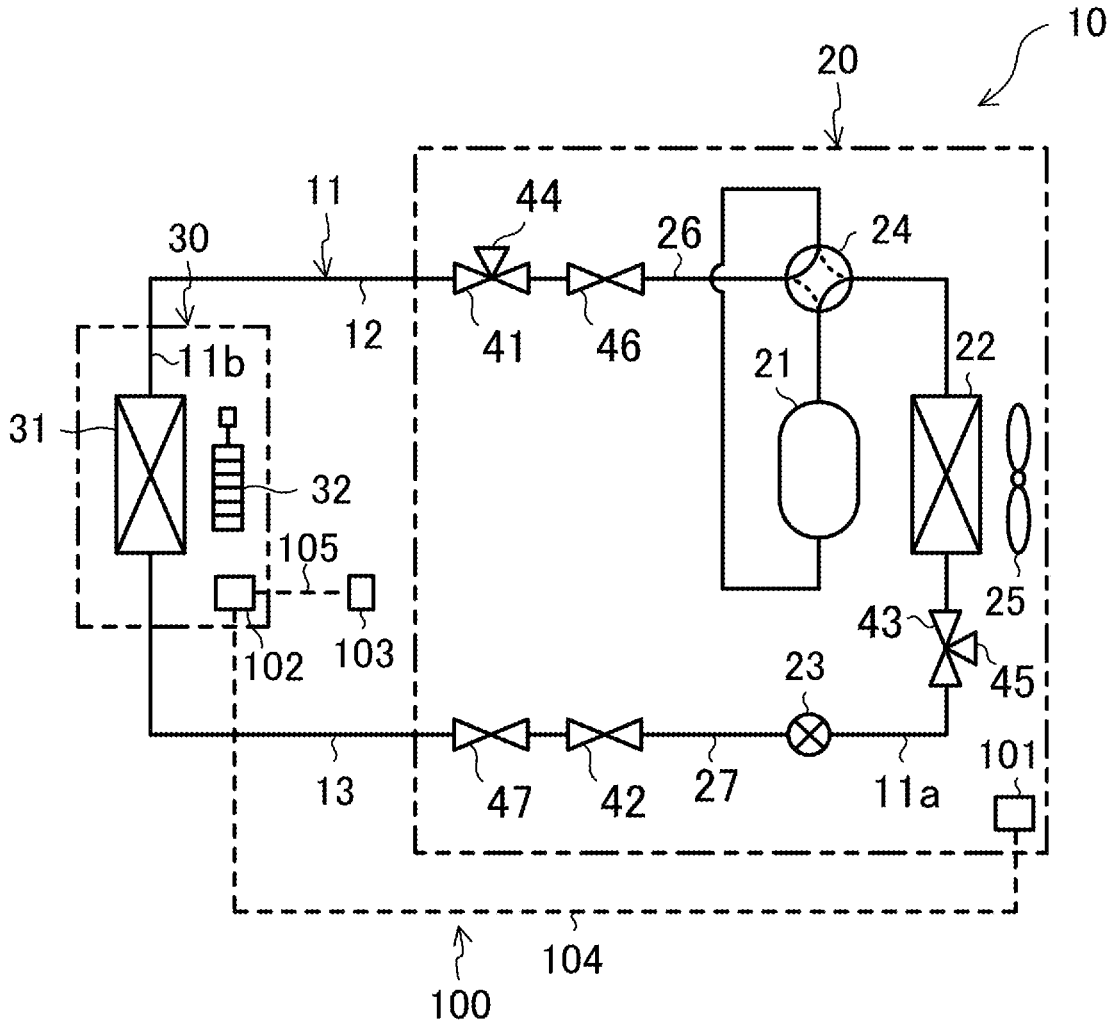
FIG. 5 is a diagram corresponding to FIG. 1 and illustrates a first variation.

As illustrated in FIG. 5, the second shut-off valve (47) may be connected to the other end of the liquid line (27). In this case, the second stop valve (42) is located at a portion of the liquid line (27) so as to be closer to the outdoor heat exchanger (22) than the second shut-off valve (47) is. The second stop valve (42) is located between the second shut-off valve (47) and the expansion valve (23) in the liquid line (27).

(7-2) Second Variation

Figure 6:
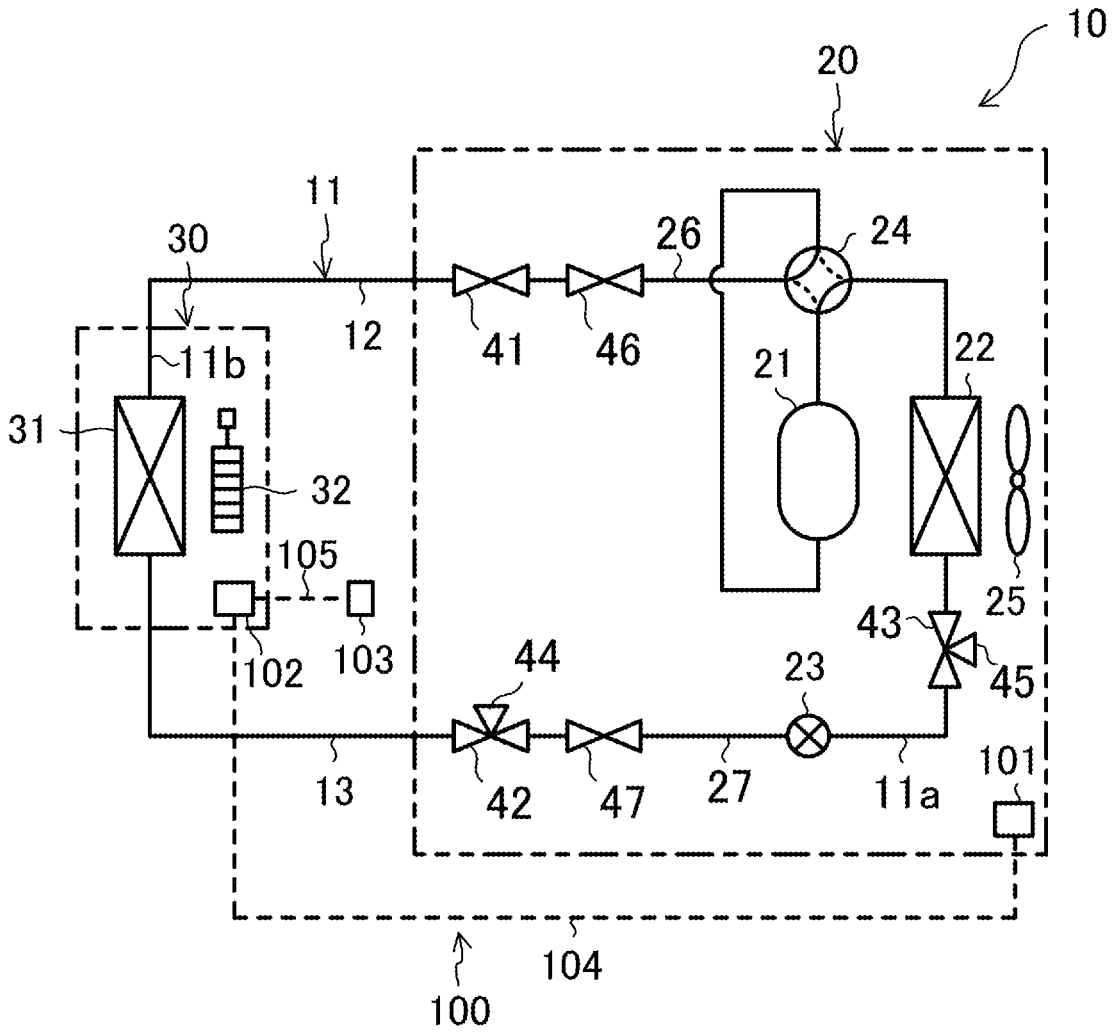
FIG. 6 is a diagram corresponding to FIG. 1 and illustrates a second variation.

As illustrated in FIG. 6, the second stop valve (42) may have a first service port (44). In other words, the first stop valve (41) does not have a first service port (44). In this case, the refrigerant on the indoor unit (30) side can be recovered through the first service port (44) of the second stop valve (42) after the first shut-off valve (46) and the second shut-off valve (47) are closed.

(7-3) Third Variation

Figure 7:
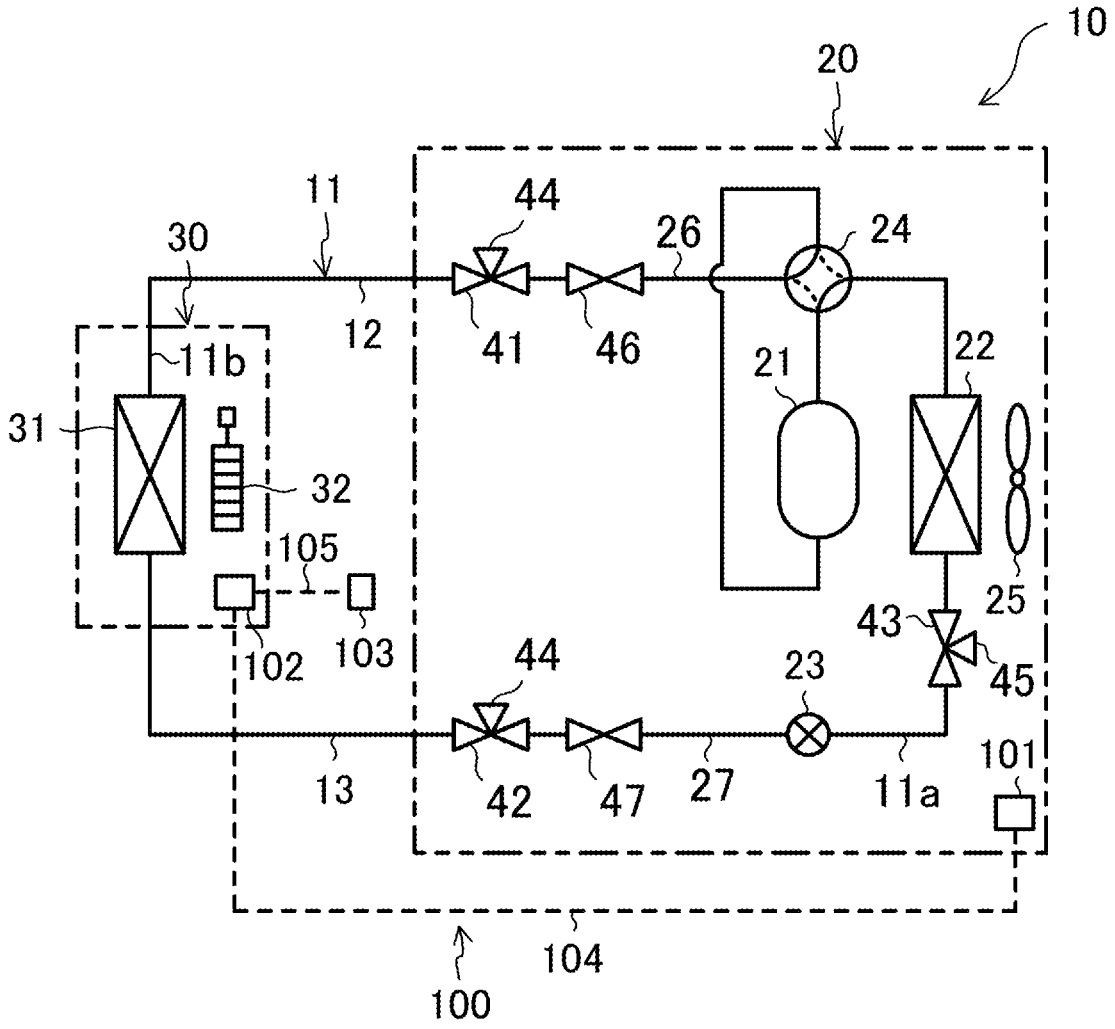
FIG. 7 is a diagram corresponding to FIG. 1 and illustrates a third variation.

As illustrated in FIG. 7, each of the first stop valve (41) and the second stop valve (42) may have the first service port (44). In this case, at least one of the shut-off valves (46, 47) that corresponds to one (41, 42) of the first stop valve (41) or the second stop valve (42) having the first service port (44) is closer to the outdoor heat exchanger (22) than the stop valve (41, 42) is.

In this variation, for example, as illustrated in FIG. 7, the first shut-off valve (46) that corresponds to the first stop valve (41) having the first service port (44) is closer to the outdoor heat exchanger (22) than the first stop valve (41) is. Furthermore, the second shut-off valve (47) that corresponds to the second stop valve (42) having the first service port (44) is closer to the outdoor heat exchanger (22) than the second stop valve (42) is. In this case, the refrigerant on the indoor unit (30) side can be recovered through the first service port (44) of the first stop valve (41) or the first service port (44) of the second stop valve (42) after the first shut-off valve (46) and the second shut-off valve (47) are closed.

In this variation, one of the shut-off valves (46, 47) that corresponds to the first stop valve (41) or the second stop valve (42) merely needs to be closer to the outdoor heat exchanger (22) than the corresponding stop valve (41, 42). For example, if the first shut-off valve (46) is closer to the outdoor heat exchanger (22) than the first stop valve (41), the second stop valve (42) may be closer to the outdoor heat exchanger (22) than the second shut-off valve (47) is.

(7-4) Fourth Variation

Figure 8:
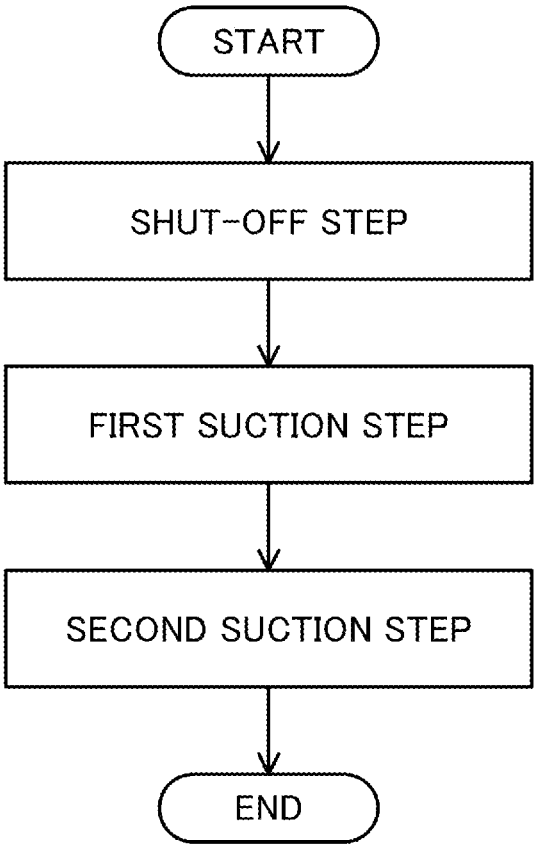
FIG. 8 is a diagram corresponding to FIG. 3 and illustrates a fourth variation.

As illustrated in FIG. 8, if the air conditioner (10) does not perform the pump-down operation, the shut-off step, the first suction step, and the second suction step may be sequentially performed in the refrigerant handling method. The phrase "if the air conditioner (10) does not perform the pump-down operation" indicates, for example, a situation where the pump-down operation cannot be performed due to a breakdown of the air conditioner (10) or a situation where the air conditioner (10) does not have the function of performing the pump-down operation.

In this variation, the operator shuts off the indoor unit (30) side and the outdoor unit (20) from each other in the shut-off step. Since the pump-down step is not performed in this variation, the refrigerant is present on the indoor unit (30) side as well. Performing the first suction step in this state enables recovery of the refrigerant on the indoor unit (30)

side. It is therefore possible to keep the refrigerant from being released into the atmosphere even if the outdoor unit (20) and the indoor unit (30) side are disconnected from each other for maintenance and relocation of the air conditioner (10).

Other Embodiments

The foregoing embodiment may be modified as follows.

The air conditioner (10) of the foregoing embodiment may be an air conditioner (10) of a multiple type having a plurality of indoor units (30).

The foregoing embodiment may be applied to a refrigeration apparatus except the air conditioner (10) as long as the refrigeration apparatus includes a refrigerant circuit that performs a refrigeration cycle. Specifically, the foregoing embodiment may be applied to a cooling apparatus configured to cool a refrigerator or a freezer, a so-called chiller unit, a heat pump water heater, or any other apparatus.

In the foregoing embodiment, the control unit (100) closes the first shut-off valve (46) and the second shut-off valve (47) in the first shut-off step by transmitting a signal for closing a valve to each of the shut-off valves (46, 47). In contrast, the shut-off valves (46, 47) may be closed by using an electric circuit constituting the control unit (100) which is configured to shut off the first shut-off valve (46) and the second shut-off valve (47) when the power supply to the outdoor unit (20) is stopped. Alternatively, the first shut-off valve (46) and the second shut-off valve (47) which have the function of opening the valve when energized and closing the valve when not energized may be used to close the shut-off valves (46, 47) when the power supply to the outdoor unit (20) is stopped.

While the embodiments and variations thereof have been described above, it will be understood that various changes in form and details may be made without departing from the spirit and scope of the claims. The embodiments, the variations, and the other embodiments may be combined and replaced with each other without deteriorating intended functions of the present disclosure.

The expressions of "first," "second," "third," . . . described above are used to distinguish the words to which these expressions are given, and the number and order of the words are not limited.

INDUSTRIAL APPLICABILITY

As can be seen from the foregoing description, the present disclosure is useful for a heat source unit and a refrigerant handling method.

EXPLANATION OF REFERENCES

10 Air Conditioner (Refrigeration Apparatus)
11 Refrigerant Circuit
20 Outdoor Unit (Heat Source Unit)
21 Compressor
22 Outdoor Heat Exchanger (Heat Source Heat Exchanger)
26 Gas Line
27 Liquid Line
30 Indoor Unit (Utilization Unit)
31 Indoor Heat Exchanger (Utilization Heat Exchanger)
41 First Stop Valve
42 Second Stop Valve
43 Third Stop Valve
44 First Service Port
45 Second Service Port
46 First Shut-Off Valve
47 Second Shut-Off Valve

The invention claimed is:

1. A heat source unit connected to a utilization unit including a utilization heat exchanger, the heat source unit performing a refrigeration cycle using a refrigerant that circulates, the heat source unit comprising:
a compressor;
a heat source heat exchanger;
a gas line having one end joined to a gas end of the heat source heat exchanger;
a liquid line having one end joined to a liquid end of the heat source heat exchanger;
a first stop valve and a first shut-off valve which are connected to a portion of the gas line near another end of the gas line; and
a second stop valve and a second shut-off valve which are connected to a portion of the liquid line near another end of the liquid line, wherein
the first shut-off valve and the second shut-off valve are closed when power supply to the heat source unit is stopped,
at least one of the first stop valve or the second stop valve has a first service port,
at least one of the first shut-off valve or the second shut-off valve which corresponds to the at least one of the stop valves having the first service port is closer to the heat source heat exchanger than the at least one of the stop valves having the first service port is, and
the first stop valve and the first shut-off valve, and the second stop valve and the second shut-off valve are separated from each other, respectively.

2. The heat source unit of claim 1, wherein
the first stop valve has the first service port, and
the first shut-off valve is closer to the heat source heat exchanger than the first stop valve is.

3. The heat source unit of claim 2, wherein
the second shut-off valve is closer to the heat source heat exchanger than the second stop valve is.

4. The heat source unit of claim 3 further comprising:
a third stop valve having a second service port, wherein
the third stop valve is closer to the heat source heat exchanger than the first shut-off valve of the gas line and the second shut-off valve of the liquid line are.

5. The heat source unit of claim 3, wherein
the refrigerant is a flammable refrigerant.

6. The heat source unit of claim 2 further comprising:
a third stop valve having a second service port, wherein
the third stop valve is closer to the heat source heat exchanger than the first shut-off valve of the gas line and the second shut-off valve of the liquid line are.

7. The heat source unit of claim 6, wherein
the third stop valve is connected to the liquid line.

8. The heat source unit of claim 2, wherein
the refrigerant is a flammable refrigerant.

9. The heat source unit of claim 1 further comprising:
a third stop valve having a second service port, wherein
the third stop valve is closer to the heat source heat exchanger than the first shut-off valve of the gas line and the second shut-off valve of the liquid line are.

10. The heat source unit of claim 9, wherein
the third stop valve is connected to the liquid line.

11. The heat source unit of claim 10, wherein
an opening area of the second service port is greater than an opening area of the first service port.

12. The heat source unit of claim 10, wherein the refrigerant is a flammable refrigerant.

13. The heat source unit of claim 9, wherein an opening area of the second service port is greater than an opening area of the first service port.

14. The heat source unit of claim 13, wherein the refrigerant is a flammable refrigerant.

15. The heat source unit of claim 9, wherein the refrigerant is a flammable refrigerant.

16. The heat source unit of claim 1, wherein the refrigerant is a flammable refrigerant.

17. A refrigerant handling method for handling a refrigerant with which a refrigerant circuit of a refrigeration apparatus is filled, the refrigeration apparatus including a utilization unit and a heat source unit, the refrigerant handling method comprising:

a first step of shutting off the refrigerant circuit between the utilization unit and the heat source unit on a site where the refrigeration apparatus is installed;

a second step of, after an end of the first step, sucking the refrigerant on a utilization unit side on the site where the refrigeration apparatus is installed;

a third step of, after an end of the second step, sucking the refrigerant in the heat source unit through a facility that recovers the refrigerant; and a fourth step of performing a pump-down operation to move the refrigerant on the utilization unit side to the heat source unit, wherein the first step is performed after an end of the fourth step.

18. The method of claim 17, wherein the heat source unit includes:

a compressor;

a heat source heat exchanger;

a gas line having one end joined to a gas end of the heat source heat exchanger;

a liquid line having one end joined to a liquid end of the heat source heat exchanger;

a first stop valve and a first shut-off valve which are connected to a portion of the gas line near another end of the gas line; and a second stop valve and a second shut-off valve which are connected to a portion of the liquid line near another end of the liquid line, wherein the first shut-off valve and the second shut-off valve are closed when power supply to the heat source unit is stopped, at least one of the first stop valve or the second stop valve has a first service port, at least one of the first shut-off valve or the second shut-off valve which corresponds to the at least one of the stop valves having the first service port is closer to the heat source heat exchanger than the at least one of the stop valves having the first service port is, and the first step includes:

a fifth step of closing the first shut-off valve and the second shut-off valve; and a sixth step of closing the first stop valve and the second stop valve.

19. A refrigerant handling method for handling a refrigerant with which a refrigerant circuit of a refrigeration apparatus is filled, the refrigeration apparatus including a utilization unit and a heat source unit, the refrigerant handling method comprising:

a first step of shutting off the refrigerant circuit between the utilization unit and the heat source unit on a site where the refrigeration apparatus is installed;

a second step of, after an end of the first step, sucking the refrigerant on a utilization unit side on the site where the refrigeration apparatus is installed;

a third step of, after an end of the second step, sucking the refrigerant in the heat source unit through a facility that recovers the refrigerant, wherein the heat source unit includes:

a compressor;

a heat source heat exchanger;

a gas line having one end joined to a gas end of the heat source heat exchanger;

a liquid line having one end joined to a liquid end of the heat source heat exchanger;

a first stop valve and a first shut-off valve which are connected to a portion of the gas line near another end of the gas line; and a second stop valve and a second shut-off valve which are connected to a portion of the liquid line near another end of the liquid line, wherein the first shut-off valve and the second shut-off valve are closed when power supply to the heat source unit is stopped, at least one of the first stop valve or the second stop valve has a first service port, at least one of the first shut-off valve or the second shut-off valve which corresponds to the at least one of the stop valves having the first service port is closer to the heat source heat exchanger than the at least one of the stop valves having the first service port is, and the first step includes:

a fifth step of closing the first shut-off valve and the second shut-off valve; and a sixth step of closing the first stop valve and the second stop valve.

* * * * *